US008371058B2

(12) United States Patent
Trpcic

(10) Patent No.: US 8,371,058 B2
(45) Date of Patent: Feb. 12, 2013

(54) MECHANISM FOR THE DISASSEMBLY OF A HANDGUN WITHOUT TRIGGERING

(75) Inventor: Dubravko Trpcic, Karlovac (HR)

(73) Assignee: HS Produkt D.O.O., Karlovac (HR)

( * ) Notice: Subject to any disclaimer, the term of this patent is extended or adjusted under 35 U.S.C. 154(b) by 152 days.

(21) Appl. No.: 12/997,015

(22) PCT Filed: Jun. 24, 2009

(86) PCT No.: PCT/HR2009/000023

§ 371 (c)(1),
(2), (4) Date: Dec. 9, 2010

(87) PCT Pub. No.: WO2009/156774

PCT Pub. Date: Dec. 30, 2009

(65) Prior Publication Data

US 2011/0162248 A1 Jul. 7, 2011

(30) Foreign Application Priority Data

Jun. 26, 2008 (HR) ..... P 20080302 A

(51) Int. Cl.
*F41C 27/00* (2006.01)

(52) U.S. Cl. ..... 42/108; 42/70.08

(58) Field of Classification Search ..... 42/70.08, 42/108; 89/144, 145, 147
See application file for complete search history.

(56) References Cited

U.S. PATENT DOCUMENTS

| | | | | |
|---|---|---|---|---|
| 5,259,138 | A | 11/1993 | Scirica | |
| 6,263,607 | B1 | 7/2001 | Fuchs et al. | |
| 7,140,141 | B2 * | 11/2006 | Vaid | 42/108 |
| 7,392,611 | B2 * | 7/2008 | Curry | 42/69.01 |

FOREIGN PATENT DOCUMENTS

WO WO 82/03910 11/1982

OTHER PUBLICATIONS

Ezell, E.C., "Small Arms of the World—A Basic Manual of Small Arms," Jan. 1, 1983, Stackpole Books, Harrisburg, US, Part I, Chapter 4 "Handgun Developments" pp. 136-152.
International Search Report for PCT International Application No. PCT/HR2009/000023 mailed Nov. 26, 2009.
Written Opinion of the International Search Authority for PCT International Application No. PCT/HR2009/000023 mailed Nov. 26, 2009.

* cited by examiner

*Primary Examiner* — Stephen M Johnson
(74) *Attorney, Agent, or Firm* — RatnerPrestia

(57) ABSTRACT

A mechanism for the disassembly of a handgun without triggering, which prevents the consequential accidental firing of a cartridge in the chamber upon triggering. The mechanism including a disassembler, sear catcher lever, sear catcher and a sear catcher spring. The disassembler has an eccentric pin. Rotation of the dissembler moves the sear catcher lever forward. The sear catcher spring pushes the sear catcher which abuts the other end of sear catcher lever. The sear catcher can catch the sear as soon as the sear is pressed downwards around the sear pin by the slide, and it can hold the sear beneath the plane of cocking of the firing pin. At the same time, the sear catcher blocks the firing pin safety lever if the sear catcher lever is in its utmost forward position. That way the cocking of the firing pin is prevented and the triggering is blocked.

1 Claim, 6 Drawing Sheets

MECHANISM FOR THE DISASSEMBLY OF A HANDGUN WITHOUT TRIGGERING

DESCRIPTION OF INVENTION

Field of Invention

The subject invention refers to the mechanism for the disassembly of a handgun without triggering. According to the field of invention, the aforementioned invention can be classified into the field of functional characteristics of handguns upon assembly and disassembly of the weapon, which prevents accidental firing during the process of disassembly.

Technical Problem

The technical problem that this subject invention solves is of a safety nature and it refers to the construction of the handgun mechanism which enables the disassembly of a handgun without triggering. To disassemble a handgun with a cocked firing pin, the triggering of a handgun must be performed during the disassembly. Every such triggering poses potential danger if the gun operator does not follow the procedure. Namely, the dismantling procedures stipulate that the loaded magazine must be removed before the dismantling in order to prevent the loading of the barrel upon the disassembly and the consequential accidental firing when the triggering, which is an inevitable part of the disassembly, is performed.

State of Art

In the state of art, the solutions for the disassembly of a handgun with a cocked firing pin are already known. For example, the international patent application PCT/AT82/00015; by the holder GLOCK, Gaston; describes the technical solution for a handgun that is disassembled in such a way that the magazine is first removed from the grip, then the slide is pulled back and released, and the round that remained in the chamber is ejected. However, before the process of disassembly continues, one must uncock the firing pin which is still cocked and therefore the slide cannot be detached. In order to detach the slide, one must perform the triggering—which poses the risk described in the technical problem.

Another technical solution SIG ARMS INTERNAT AG described in the U.S. Pat. No. 6,263,607 teaches of a mechanism that solves the technical problem of a disassembly and accidental firing from PCT/AT82/00015. That technical solution differs significantly with regard to the subject invention. It is a different technical solution that has the same final technical effect.

THE SUMMARY OF THE INVENTION

According to the invention, the mechanism consists of the disassembler, the sear catcher lever, the sear catcher and the sear catcher spring. The disassembler contains an eccentric pin and the lever for the moving of a disassembler which is positioned on the outside of the receiver. Rotating the disassembly lever by a quarter of a circle moves its eccentric pin and at the same time it moves the sear catcher lever as well. The sear catcher abuts the other end of the sear catcher lever and it is pressed by the sear catcher spring. The sear catcher can catch the sear in case the slide pressed the said sear downwards and around the sear pin, and it can keep it beneath the plane of the cocking of a firing pin. At the same time, the sear catcher blocks the firing pin safety lever when the sear catcher lever is in its utmost right position. This way the cocking of the firing pin is prevented and at the same time the triggering is blocked.

BRIEF DESCRIPTION OF THE FIGURES

FIG. 1 shows the spatial layout of the elements which form the mechanism for the disassembly of a handgun without triggering.

FIG. 2 shows the initial state of a handgun before the disassembly.

FIG. 3 shows the first state of the disassembly of a handgun.

FIG. 4 shows the mechanism for the disassembly of a handgun without triggering before the disassembly—when it is in a state shown in FIG. 2.

FIG. 5 shows the mechanism for the disassembly of a handgun without triggering at the first stage of a disassembly—when it is in a state shown in FIG. 3.

FIG. 6 shows an enlarged detail "D" from FIG. 4.

FIG. 7 shows an enlarged detail "V" from FIG. 5.

FIG. 8 shows the process of assembly.

FIG. 9 shows the state of the mechanism for the disassembly of a handgun without triggering as shown in FIG. 8.

FIG. 10 shows an enlarged detail "I" from FIG. 9.

A DETAILED DESCRIPTION OF THE INVENTION

Figure 1:
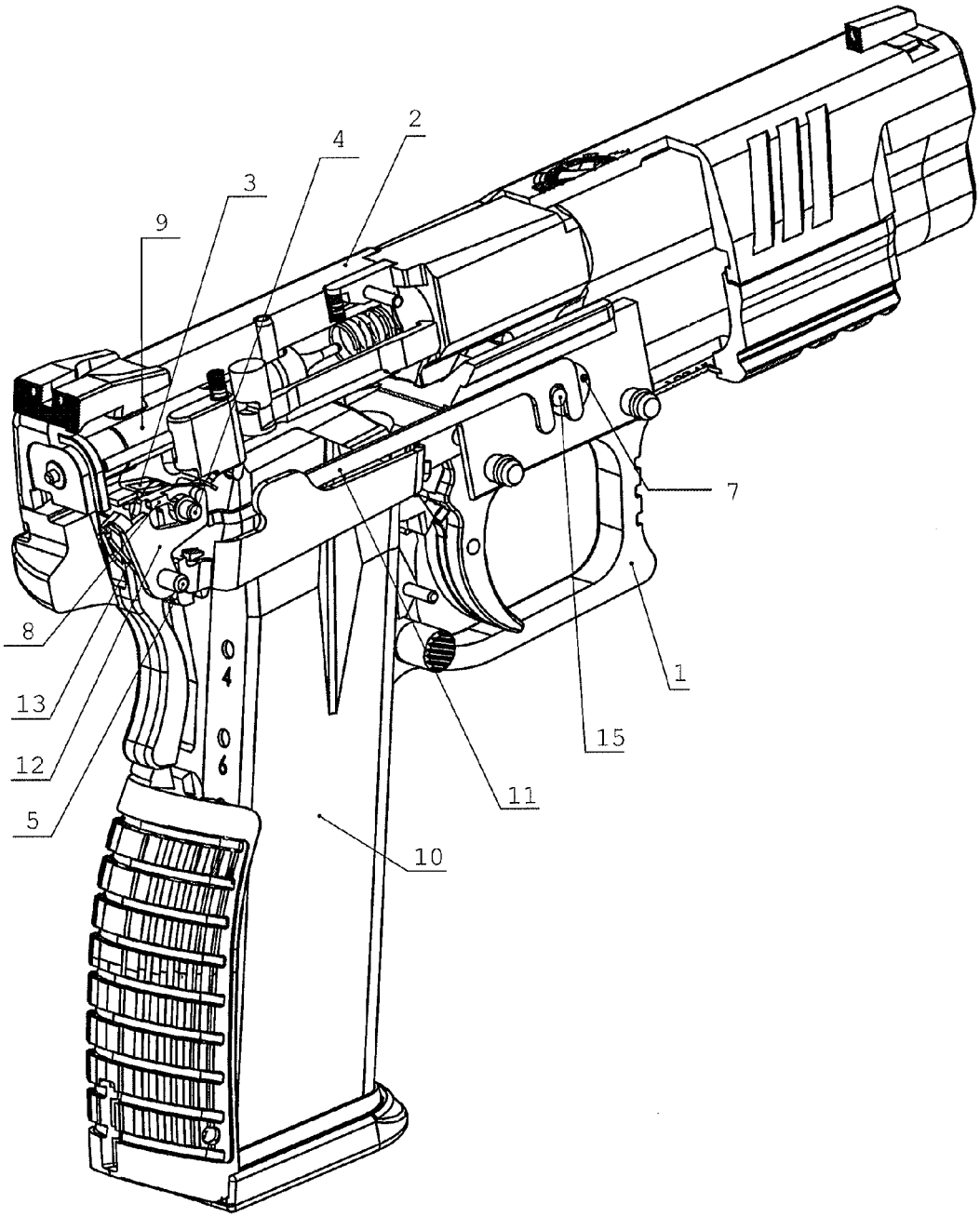
FIGS. 1-10 describe the subject invention.
Figure 2:
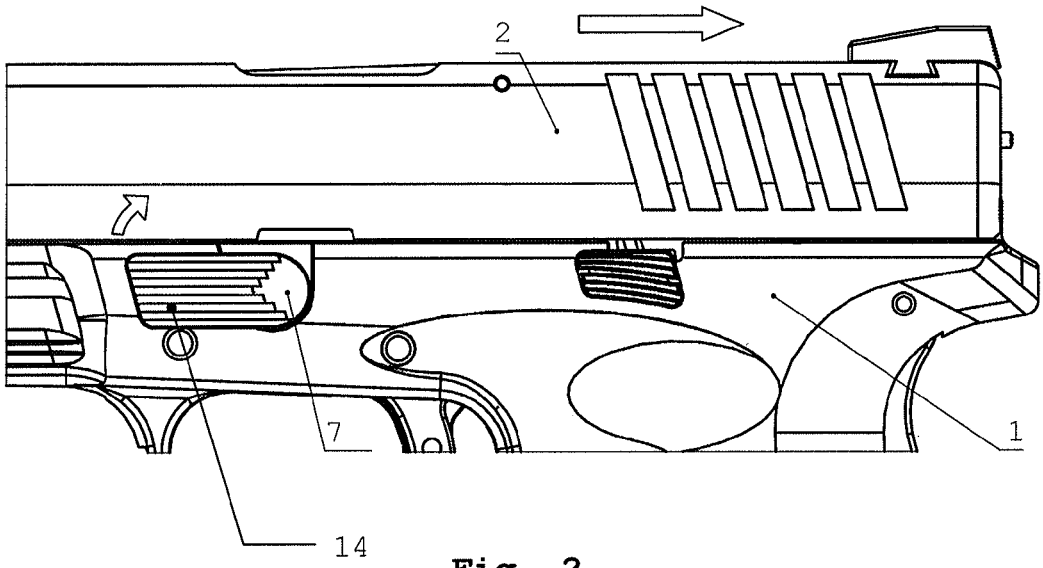

The solution that enables the solving of a technical problem of disassembling a handgun without triggering is shown at different stages in FIGS. 1-10. FIG. 1 identifies most parts of the mechanism that take part in the forming of the technical solution. Parts of the mechanism are contained (and hidden from the gun operator's sight) inside the receiver. During the normal usage of a handgun, the slide (2) slides above the receiver body (1) as is known from the previous art. FIG. 1 also shows the sear (3), sear pin (4), grip safety pin (5), firing pin safety lever (8), firing pin (9), magazine (10), sear catcher (12) and the position of the sear catcher spring (13). The position of the mechanism for the disassembly of a handgun without triggering is shown at a stage when the disassembly is not possible. That can be seen from the position of an eccentric pin (15) of the disassembler (7) in FIG. 1.

From gun operator's perspective, the disassembly of a handgun starts by removing the magazine (10). After that, the slide (2) is pulled back from the position in FIG. 2 (in the direction of the arrow) into position in FIG. 3, until the slide stop lever (6), which is positioned on the receiver, does not fit the slot provided on the slide (2). Then the lever (14) of the disassembler (7) rotates by 90° in the direction of the arrow in FIG. 2 to get into position shown in FIG. 3. This action actuates the internal mechanism. Such sequence enables the slide (2) to be removed off the receiver (1) by slight additional backwards pulling and running the entire slide (2) forward. In so doing, the firing pin (9) does not get cocked on the sear (3), i.e. it is not necessary to perform triggering, and the triggering itself is entirely disabled by a mechanism the functioning of which will be described in detail.

Figure 4:
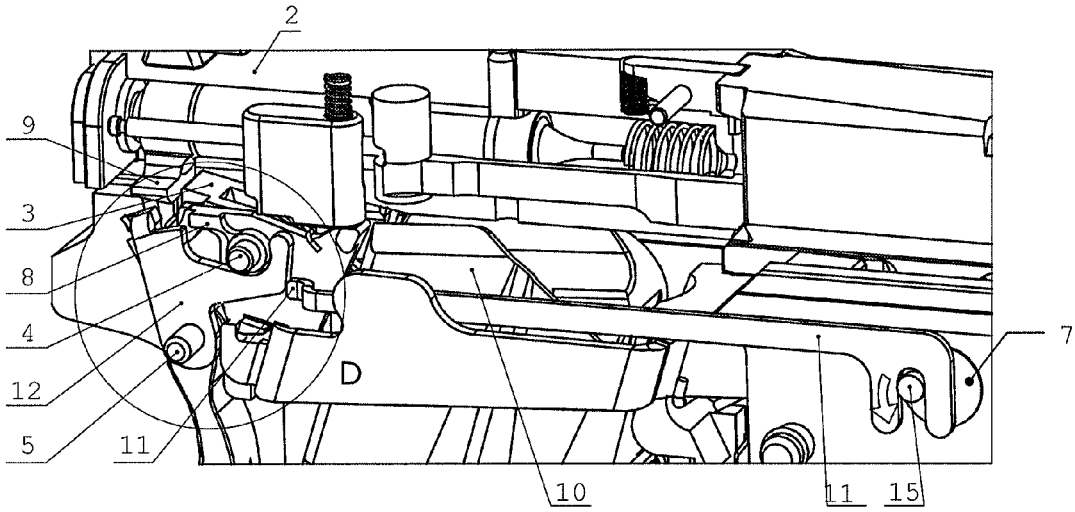
Figure 5:
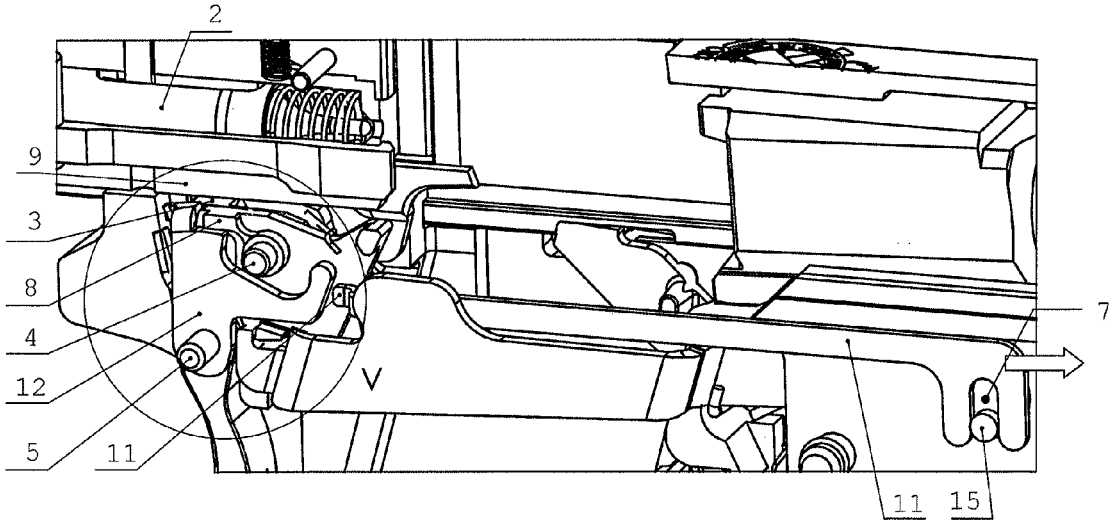

The disassembly lever (14) is tied to the disassembler (7) which has an eccentric pin (15) that affects the horizontal moving of the sear catcher lever (11) as shown in FIGS. 4 and 5. The state of the mechanism of the subject invention before the lever (14) of the disassembler (7) rotates by 90° is shown in FIG. 4. The eccentric pin (15) of the disassembler (7) is positioned to the utmost left, which brings the sear catcher lever (11) into the utmost left position.

Figure 3:
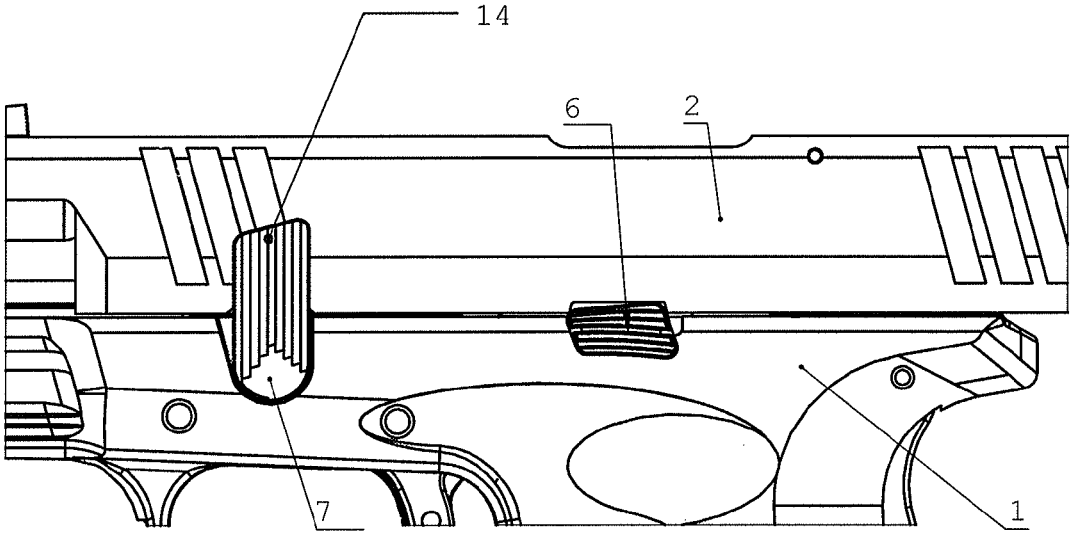

After the lever (14) of the disassembler (7) rotates by a quarter of a circle, i.e. by 90°, as shown in FIG. 3, that causes the eccentric pin (15) to pivot downwards in the direction of an arrow shown in FIG. 4, and it gets in the lower position as shown in FIG. 5. Such moving of the eccentric pin (15) of the disassembler (7) results in moving the sear catcher lever (11) towards the right, in the direction of the arrow in FIG. 5.

Figure 6:
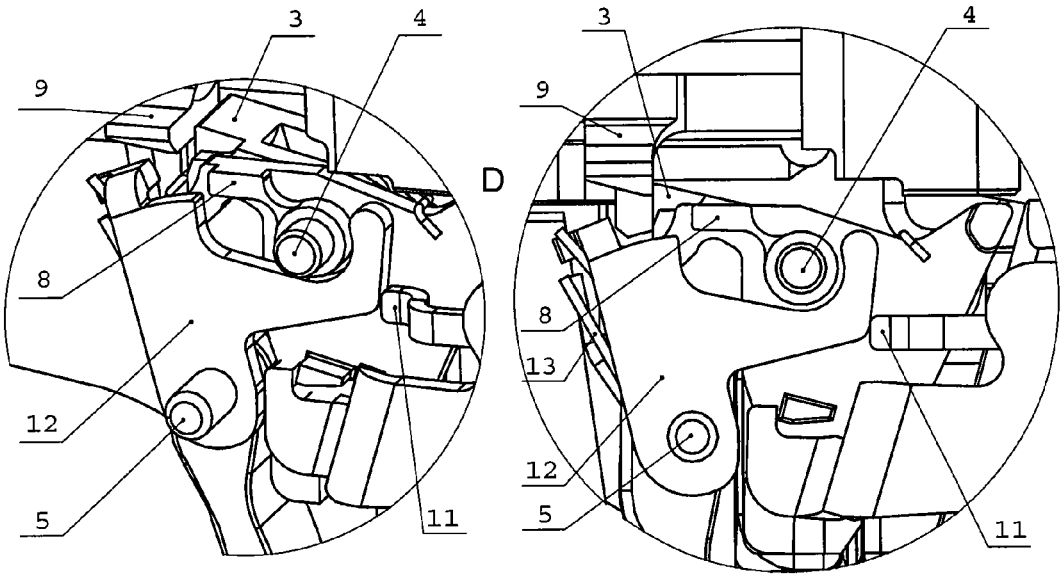

Detail "D" shown in FIG. 6 shows the state before the lever (14) of the disassembler (7) was pivoted and before the slide (2) was pulled into the retracted position, so that situation fits the state in FIG. 4. Such layout corresponds with the state before the disassembly of a handgun. It can be seen that the sear catcher lever (11) pushes the sear catcher (12) counterclockwise around the grip safety pin (5), which prevents the sear catcher (11) from catching the sear (3) or blocking the firing pin safety lever (8). At the same time, the sear (3) cocks the firing pin (9) because the sear spring (which is not a part of the invention and is not shown) elevates it to that plane and rotates it clockwise around the pin (4).

Figure 7:
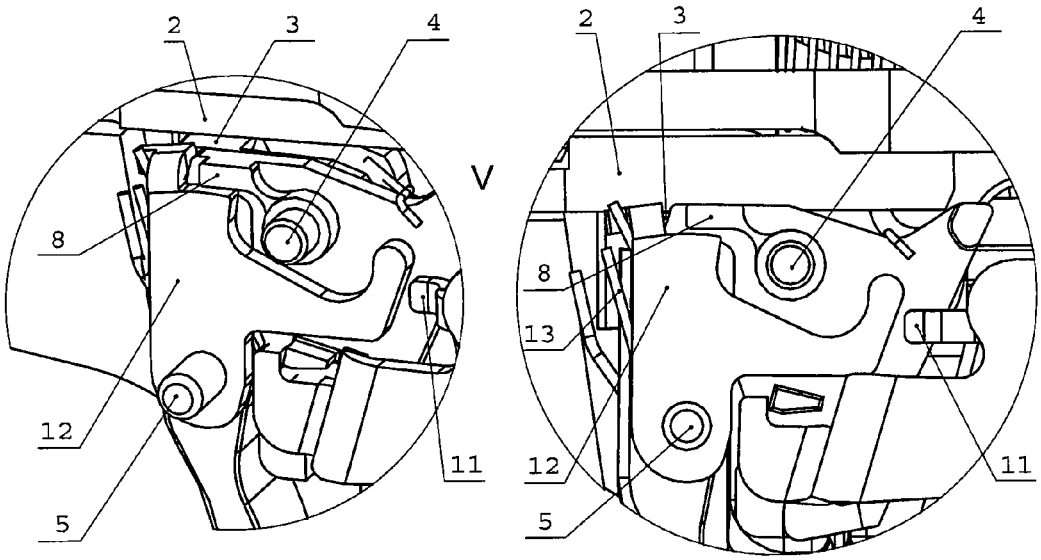
Figure 8:
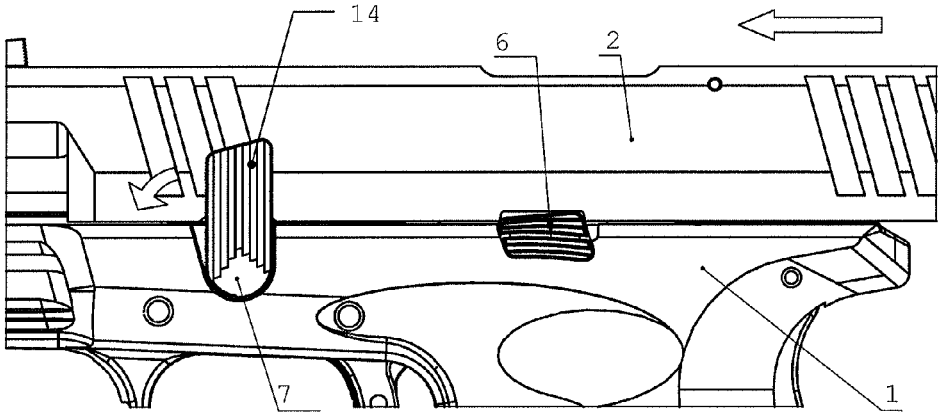
Figure 10:
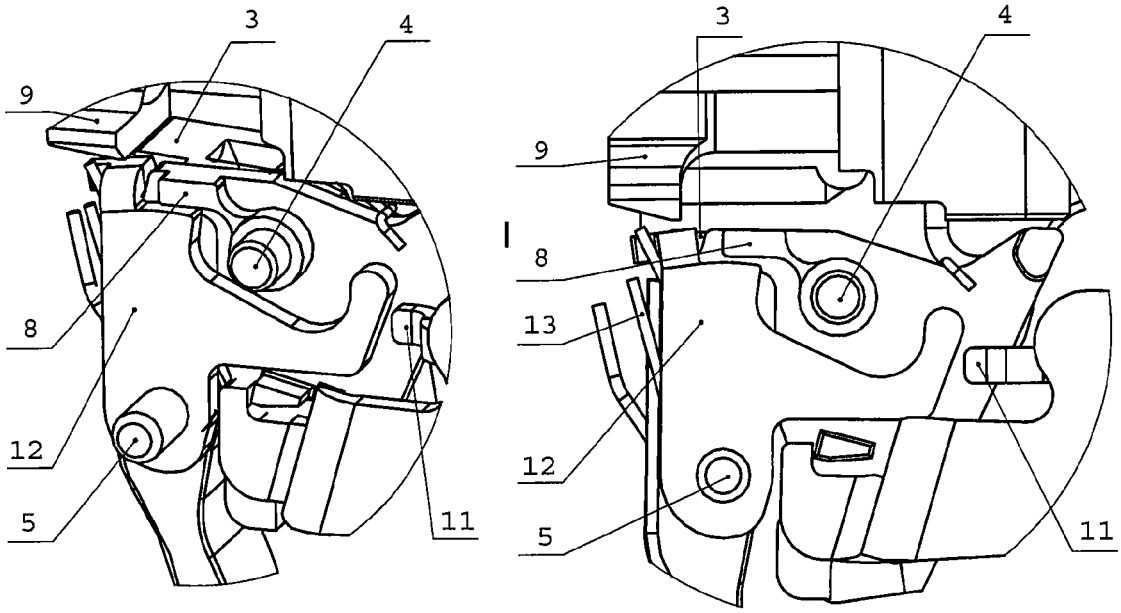

Detail "V" shown in FIG. 7 shows the state after the slide (2) was pulled into a retracted position and when the lever (14) of the disassembler (7) is rotated by 90° which matches the situation in FIG. 5. The retracted slide (2) pushes the sear (3) downwards, i.e. counterclockwise, around the sear pin (4), and it lowers the sear beneath the plane of the cocking of the firing pin (9). By pivoting the disassembler (7), the sear catcher lever (11) moves towards the right, so the sear catcher spring (13) pushes and rotates the sear catcher (12) clockwise around the grip safety pin (5). The motion of the sear catcher (12) allows for the sear catcher (12) to be able to catch the lowered sear (3) with its upper prong, and simultaneously block the moving of the firing pin safety lever (8) around the sear pin (4) in a way that the sear catcher (12) partially slides under the firing pin safety lever (8)—FIG. 7. Since the sear (3) is caught in a position beneath the plane of the cocking of the firing pin (9), this allows for the slide (2) to be removed from the receiver (1) by moving the slide forward, without the firing pin (9) being cocked by the sear (3). The relation between the position of the sear (3), the firing pin (9) and the firing pin safety lever (8) is shown in FIGS. 10 and 11. This solves the described technical problem so there is no need to perform triggering which is, inter alia, disabled by additional blocking of the firing pin safety lever (8).

The assembly of a handgun is performed in the opposite way. When the slide (2) is set in the position shown in FIG. 8, the lever (14) of the disassembler (7) is first pushed and rotated counterclockwise, i.e. downwards by 90°, and then the slide is pushed (2) in the direction of the arrow in FIG. 8. Thus the assembly of the handgun from the user's perspective is—complete.

Figure 9:
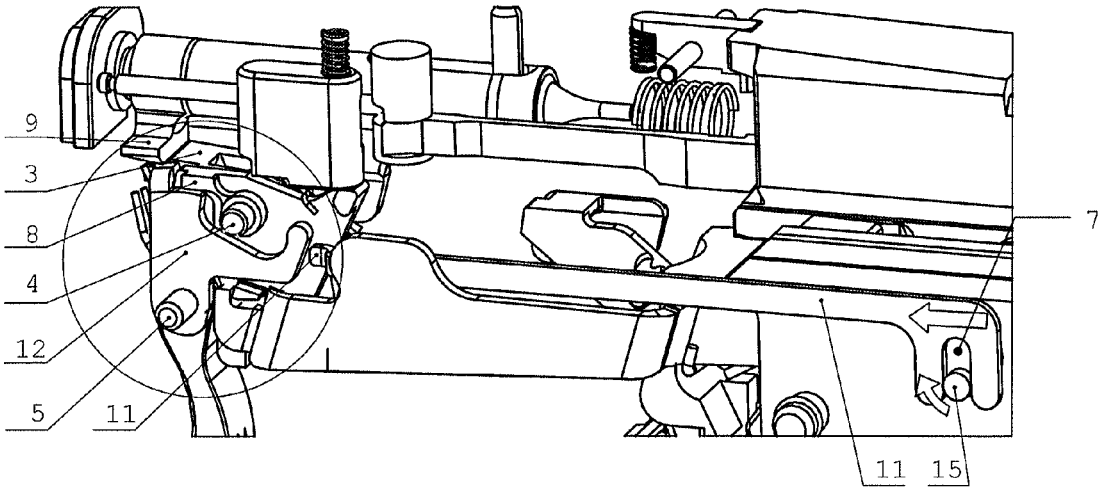

During the assembly, the disassembler (7) holds the sear catcher lever (11) in such a position that the sear catcher (12) still holds the caught sear (3) below the plane of the cocking of the firing pin (9) and it keeps the firing pin safety lever (8) blocked. This situation is shown in FIG. 9 where the detail "I" is shown separately in FIG. 10. FIG. 10 shows that the sear (3) is positioned beneath the range of the firing pin (9). After pivoting the disassembler lever (14), the eccentric pin (15) of a disassembler (7) moves in the direction of the arrow in FIG. 9, which results in moving the sear catcher lever (11) towards the left as marked in FIG. 9. Thus the mechanism returns to the state shown in FIG. 4; the sear (3) rotates around the sear pin (4) pressed by its lever (which is not the subject of the invention) into a position where it cocks the firing pin (9). The firing pin safety lever (8) is unblocked by the sear catcher (12). All that is left is to insert the loaded magazine (10) into the grip.

INDUSTRIAL APPLICABILITY

This mechanism for the disassembly of a handgun without triggering can be entirely incorporated into a handgun, together with other supporting mechanisms. Its feature is that by a small number of additional parts it fulfills the desired technical purpose—the disassembly of a handgun without triggering. Therefore, industrial applicability of the invention as such is unquestionable and it contributes to the safety of handling the said handgun during maintenance/cleaning.

REFERENCES (1) receiver
(2) slide
(3) sear
(4) sear pin
(5) grip safety pin
(6) slide stop lever
(7) disassembler
(8) firing pin safety lever
(9) firing pin
(10) magazine
(11) sear catcher lever
(12) sear catcher
(13) sear catcher spring
(14) disassembler lever
(15) eccentric pin

The invention claimed is:

1. A mechanism for the disassembly of a handgun without triggering comprising a disassembler having a lever positioned at an outer side of a handgun receiver wherein:

the disassembly mechanism further comprises a sear catcher lever, a sear catcher and a sear catcher spring;

the disassembler has an eccentric pin which upon rotation by a quarter circle of the dissembler lever is moved in such way that it moves the sear catcher lever in a forward direction parallel to the slide's plane of movement on the receiver;

the sear catcher abuts the end of the sear catcher lever and is urged by the sear catcher spring into a rotational movement around a grip safety pin;

the sear catcher can catch a sear when the sear is pressed downwards around a sear pin by the slide, and the sear catcher can hold the sear beneath the plane of the cocking of a firing pin, while at the same time the sear catcher also blocks a firing pin safety lever if the sear catcher lever is in its utmost forward position;

so that when the slide is removed from the receiver the firing pin is not cocked, thus obviating the need for triggering.

* * * * *